United States Patent [19]

Pohland

[11] 4,128,679

[45] Dec. 5, 1978

[54] SOFT, NON-WOVEN FABRICS AND PROCESS FOR THEIR MANUFACTURE

[75] Inventor: Alois Pohland, Weinheim, Germany

[73] Assignee: Firma Carl Freudenberg, Weinheim, Germany

[21] Appl. No.: 516,837

[22] Filed: Oct. 21, 1974

Related U.S. Application Data

[63] Continuation of Ser. No. 306,126, Nov. 13, 1972, abandoned.

[30] Foreign Application Priority Data

Nov. 17, 1971 [DE] Fed. Rep. of Germany ..... 2156961

[51] Int. Cl.[2] ..... B32B 3/10; B32B 31/00

[52] U.S. Cl. ..... 428/131; 28/106; 156/148; 156/252; 156/181; 156/513; 428/198; 428/296; 428/288

[58] Field of Search ..... 156/251, 513, 252, 515, 156/296, 555, 148, 270, 181, 290, 253, 306, 269; 264/156, 154, 103, 126; 28/72 NW, 72.2 R; 428/131, 245, 195, 258, 198, 296, 236, 280, 238

[56] References Cited

U.S. PATENT DOCUMENTS

| | | | |
|---|---|---|---|
| 2,464,301 | 3/1949 | Francis | 156/220 |
| 3,507,943 | 4/1970 | Such et al. | 264/119 |
| 3,719,736 | 3/1973 | Woodruff | 156/252 |

FOREIGN PATENT DOCUMENTS

| | | | |
|---|---|---|---|
| 573297 | 3/1959 | Canada | 156/252 |

*Primary Examiner*—William A. Powell
*Assistant Examiner*—J. J. Gallagher
*Attorney, Agent, or Firm*—Sprung, Felfe, Horn, Lynch & Kramer

[57] ABSTRACT

A soft, non-woven fabric containing no binding agents and composed, at least in part, of thermoplastic fibers bonded to other fibers at their crossing points, which non-woven fabric is produced by a process which comprises passing a mat composed of said thermoplastic fibers over a surface and to said mat applying an uneven heated surface, said heated surface being sufficient to fuse, at least in part, a portion of said thermoplastic fibers to other fibers at some but not all of their crossing points, while at the same time the fusing is effected without any substantial compression of the fabric.

23 Claims, 6 Drawing Figures

SOFT, NON-WOVEN FABRICS AND PROCESS FOR THEIR MANUFACTURE

This is a continuation, of application Ser. No. 306,126, filed Nov. 13, 1972, now abandoned.

BACKGROUND OF THE INVENTION

1. Field of the Invention

This invention relates to the manufacture of soft, non-woven fabrics, especially such fabrics which do not contain binding agents. More especially, this invention is directed to an inexpensive process for providing soft, non-woven fabrics free of binding agents, which fabrics do not have a papery feel. This invention is directed to the fabrics themselves and to the process for their manufacture.

2. Discussion of Prior Art

Non-woven fabrics are sheet materials made of fibers in which the fibers are, in one way or another, bonded together at their intersections or crossing points. In this manner, the initially loose, fibrous material, e.g., cotton batting-like mat receives an appreciable strengthening. The time-honored method for securing the fibers together at their crossing points involves the impregnation of a loose, fibrous mat with a latex. The so impregnated mat is thereafter dried, which allows the latex to gather mainly at the intersections of the fibers. A membrane-like adhesive bond then forms, such as the one depicted in FIG. 4 of U.S. Pat. No. 2,719,802.

Adhesive-free, so-called thermoplastic bonds have been provided in non-woven fabrics. Details of the process by which the bonds are provided can be obtained from "Non-Woven Fabrics," page 31, chapter h, "Thermoplastic Fiber Bonding." In this process, thermoplastic fibers are admixed with the starting fiber mat. This mat is then passed between a pair of hot metal rolls having smooth surfaces. The heat from the rolls softens the thermoplastic fibers and thus they bond other thermoplastic fibers, or even non-thermoplastic fibers to one another. At the intersections or crossing points of the fibers a welding takes place which can be compared with the welding produced when two red-hot wires are welded together. After cooling, the fibrous sheet metarial has a considerable stability. However, it feels much like paper.

It has long been desired to provide an especially soft, thermoplastic, welded, non-woven fabric, especially one which did not have the feel of paper. It has therefore been desirable to provide a process for producing the same.

SUMMARY OF THE INVENTION

Broadly, this invention contemplates a soft, non-woven fabric comprising, at least in part, thermoplastic fibers welded to other fibers at the crossing points thereof, which fabric is free of bonding agent. In accordance with this invention such a soft, non-woven fabric is produced by a process which comprises contacting a mat of non-woven fibers, at least a portion of which comprises thermoplastic fibers, with a heated metal surface, whose surface is uneven, under a pressure sufficient to cause the raised portions of the uneven surface to be depressed within the fibrous mat, the heat of the heated surface being sufficient to soften thermoplastic fibers and to allow them to be welded to other fibers at the crossing points thereof.

In a particularly desirable embodiment, the process of the present invention comprises passing a mat of non-woven fibers, at least a portion of which are thermoplastic fibers, into the nip defined by a first roll having a raised portion thereon and a second resilient roll, at least one of said rolls being heated sufficiently to soften said thermoplastic fibers, the nip between said rolls being sufficiently small to cause the raised portions of the first roll to depress into the surface of the non-woven fibrous mat.

The invention involves subjecting a non-woven fibrous mat containing thermoplastic fibers to a surface having raised portions, suitably raised portions on a heated roll, sufficient pressure being provided by utilizing a facing oppositely disposed roll to define a nip between the rolls through which the fibrous mat is passed. Preferably, each roller is heated sufficiently to cause the thermoplastic fibers in the non-woven fibrous mat to melt. Generally speaking, the temperature of the treatment of the fibrous mat should be between 180° C. and 250° C., preferably between 200° C. and 230° C. It will be realized that the selection of temperature will depend upon the nature of the thermoplastic fibers contained in the non-woven fibrous mat.

Suitably, the raised portions on the surface of a roller are raised at least 0.2 mm about the roll surface, preferably between 0.5 and 1 mm. Again, it will be realized that the extent to which the raised portions extend beyond the roll surface will depend upon the thickness of the non-woven mat being treated. The area of the raised portion is preferably less than 1 $mm^2$, and generally within the range of 0.5 and 2 $mm^2$. Broadly, the process is operated such that there are between 5 and 50 welded points per $cm^2$ in the non-woven fibrous mat, preferably between 25 and 40 weld points per $cm^2$. The areas between weld points remain unwelded, which gives the fibbrous sheet material its softness. Its strength, however, is nonetheless appreciable so that it has a wide variety of uses and applications.

In the process of the invention, the fibers are suitably staple fibers having a length of at least 1 cm. Generally speaking, they can have a staple fiber running between 1 cm and 6.0 cm. Additionally, it is contemplated to use continuous filaments which are randomly disposed within the non-woven fibrous mat. Use of a staple fiber insures that each fiber will be bonded to one or more adjacent fibers at two crossing points at least. Thus, between the welds there will be provided no unfixed or un-welded fibers. Hence, because staple or continuous fibers of substantial length are employed, which allows such a plurality of welds, it is quite difficult to pull the welded mat apart. Generally speaking, the fibrous mat will contain at least 25% thermoplastic fibers. Indeed, its entire fibrous content can be made of thermoplastic fibers or mixtures of thermoplastic fibers. Alternatively, it can comprise non-thermoplastic fibers such as acetate rayons, silk fibers, protein fibers, wool, cotton, linen, jute, hemp, floss and floss silk, Manila, Manila hemp, binding twine, catgut and the like. Suitably, the thermoplastic fibers can be nylon, styrene and styrene copolymers, acrylics, cellulosics, polyolefins, especially polyethylene, vinyl polymers, especially polyvinyl chloride and various fluorocarbon materials.

When the process of the present invention is performed employing facing or opposed calender rolls, one roll can consist of a metal having punctiform elevations. The roll is capable of being heated. The counter-roll should be resilient. It is desirable, also, to employ a heatable metal cylinder as the core, which is then covered with a resilient material, preferably silicone rubber.

To aid in the transfer of heat between the inner, heatable cored cylinder and the mat being bonded, the resilient covering is provided with a metallic needle felt. A covering can be used, such as the type used in card clothing. It is also contemplated to use longer needles. In this case a cylinder of the type depicted in FIG. 1 of British Pat. No. 1,176,998 can be used. The spaces between the needles are then filled with silicone rubber. In this manner, resilient metal needles extend from the heatable cylinder core almost to the surface of the silicone rubber covering. The needles improve thermal conductivity. At the same time, the resilience of these needles assures that the overall resilience of the silicone rubber covering will not be impaired. Thus the invention can be performed by covering an un-machined surface of a steel cylinder 2400 mm long and 300 mm in diameter with a $V_2A$ steel band with oriented teeth. The height of the band from the base surface to the beginning of the teeth can amount to 1.55 mm. The height of the teeth themselves can amount to 0.7 mm. The band can have approximately 14 teeth per cm of length. The thickness of the band can amount to 0.7 mm.

If a steel or other metal cylinder with elevations is not available, it is sufficient, in a simplified form of the invention, to cover the surface of a smooth metal cylinder with a wire screen. When the wire is tightly wound on the cylinder with the edge up, the lateral edges touching one another the cylinder is ready to be employed to effect the welding of the thermoplastic fibers within the non-woven mat.

BRIEF DESCRIPTION OF THE DRAWINGS

The invention will be more readily understood and appreciated when reference is made to the attached drawings in which.

DESCRIPTION OF SPECIFIC EMBODIMENTS

Figure 1:
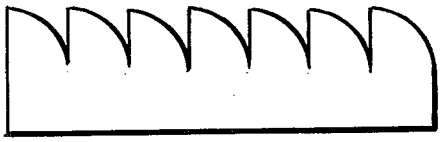
FIG. 1 is a side elevation of a toothed band to be affixed to a smooth heated calender roll to be utilized to effect depression in a non-woven mat.
Figure 2:
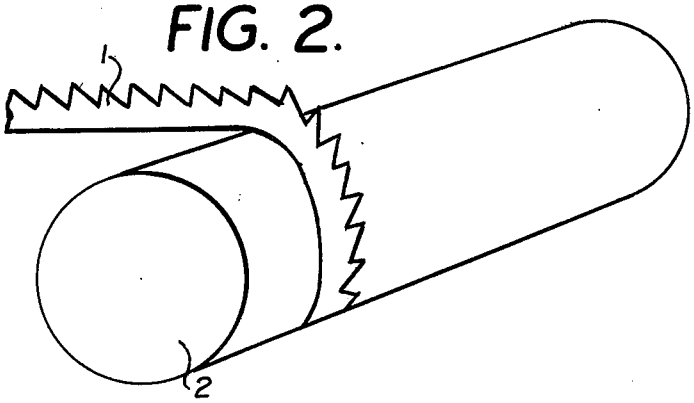
FIG. 2 is an isometric view showing the winding of the tooth band of FIG. 1 onto a smooth, heated cylinder.
Figure 4:
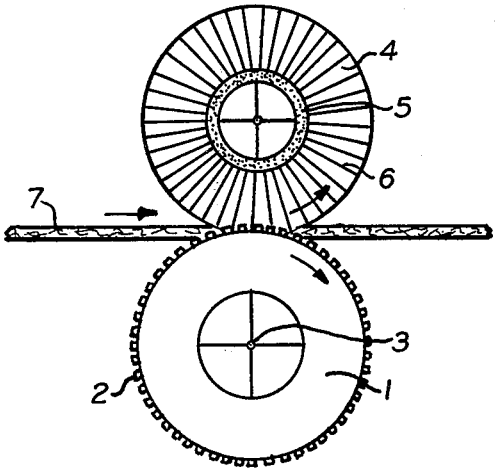
FIG. 4 shows an apparatus for the partial welding of fiber mats wherein a toothed roll is disposed in facing relationship to a roll having a resilient surface to thereby define a nip through which a non-woven fibrous mat is passed.

Referring to the drawings therein, it is seen that a wire band of FIG. 1, having raised portions is wound about a calender roll 2 to provide a tooth roll. Thus, there is employed a metal cylinder 1 having raised portions 2 which cylinder revolves about an axis 3 in the direction of the arrow shown in FIG. 4. The roll is heatable. Against this cylinder presses the counter cylinder 5 provided with silicone rubber 4. This cylinder is characterized by having needles 6 extending from the cylinder core 5 through the silicone rubber covering 4. Cylinder 5 is urged so strongly against the metal cylinder 1 that a certain demarcation takes place on the silicon rubber surface.

According to the process, mat 7 containing thermoplastic fibers to be bonded runs from the left side into the nip between the cylinders. By action of the raised portions 2 on the surface of cylinder 1 an upsetting action takes place which, at the points wherein bonding does not take place, provides the smooth feel and texture of the resultant product. At the same time as the mat passes through the nip defined by the rollers, it is bonded proximate those points at which hot raised portions or elevations 2 protrude from the cylinder 1.

Figure 5:
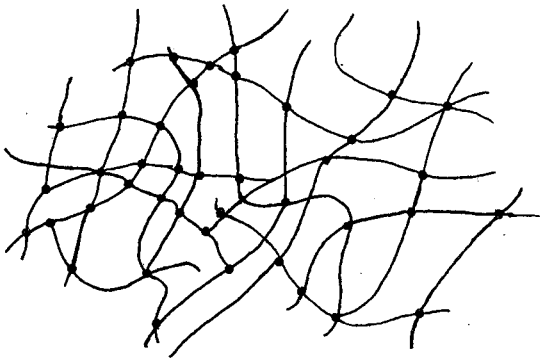
FIG. 5 is an expanded diagrammatical illustration of the binding of fibers together at their crossing points as provided by the present invention.
Figure 6:
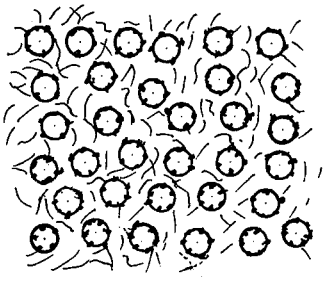
FIG. 6 is a second view which represents the situation diagrammatically. However, the holes shown in FIG. 6 are not visible in the end product owing to the fact that fibers are pushed back over these holes by the upsetting action of the depressions entering the surface of the non-woven mat.

To be precise, wherever a tooth is pressed into the mat, at first only a hole is formed. The welding of the fibers, however, takes place mainly at the margins of this hole; if a mat of thermoplastic fibers is pressed between hot, smooth rolls, the welding takes place mainly at the intersections of the fibers, as symbolized by FIG. 5. The black dots represent the welds. In the process of the invention, however, a welding action takes place mainly at the margins of the holes impressed by the teeth of the one roll into the mat.

During the passage through the roll nip, a linear pressure of 10 to 45 kg/cm is to act upon the mat. The temperature of the surface of the steel roll provided with the projections and of the silicone rubber covered roll depends on the composition of the mat to be welded. In the case of fibers with a low softening point, a surface temperature of as little as 150° C. may suffice under certain circumstances, while in the case of high-melting polyamide fibers the temperature is to rise to nearly 300° C.

Figure 3:
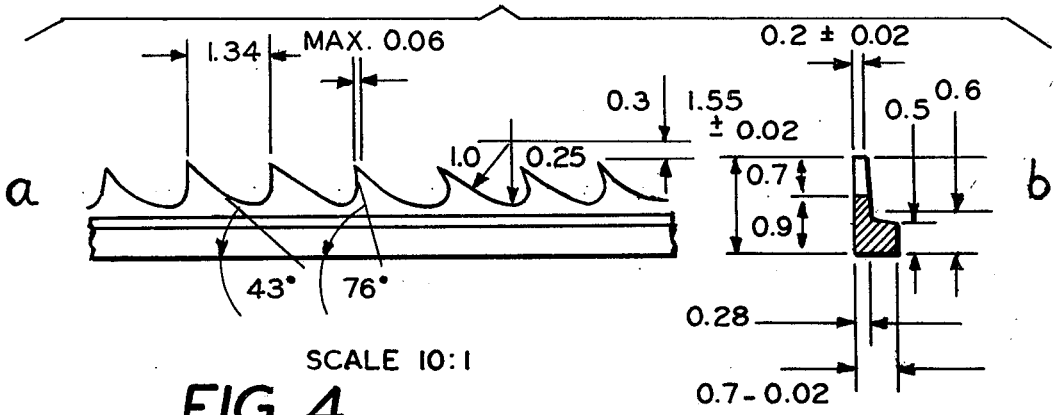
FIG. 3 is a side view similar to FIG. 1 showing the dimensions of a preferred embodiment.

With respect to FIG. 3, it is preferred that the distance between teeth measured at their apices be between 1 and 2.5 mm. The apex of a raised portion should have a surface whose linear dimension in the dimension of travel of the non-woven fabric is no greater than 0.06 mm, preferably between 0.07 and 1.2 mm. While the height of the teeth constituting the raised portions will vary, depending upon the thickness of the nonwoven fibrous mat being treated, it generally will be between 0.1 and 15 mm, especially between 0.5 and 4 mm. Similarly, the thickness of the raised portions will be between 0.15 and 1.20 mm. The most desirable dimensions are set forth with precision in FIG. 3.

The process can be operated by passing the non-woven fibrous mat through the nip at a rate between 1 and 100 meters per minute, especially at a rate between 3 and 25 meters per minute.

In order to more fully illustrate the nature of the invention and the manner of practicing the same, the following example is set forth:

EXAMPLE

Initially, a fiber mixture is prepared from 20% unstretched polyester fibers of a length of 40 to 60 mm and a fineness of 1.8 denier. The balance of the mixture consists of cellulose fibers. The fiber mixture is run through a conventional card so as to produce a mat having a weight of 50 g/m$^2$. This mat is fed to a pair of cylinders in which each cylinder has a diameter of 30 cm. The steel cylinder has a punctiform pattern in accordance with FIG. 3 of this application. The counter-cylinder has a silicone rubber covering 10 mm thick which is penetrated by resilient needles. Both cylinders are heated to 220° C. by internal heating. Then a linear pressure of 30 kg/cm is established. The mat is then passed through the cylinder nip at a speed of 3 m/min. A strong, absorbent, non-woven fabric is immediately obtained.

Generally speaking, the thermoplastic fibers which can be used to prepare the soft, non-woven sheets of the present invention have a denier between 1 and 22, preferably between 1.7 and 2.2. Suitably, they can be present in such sheet, together with other fibers having a denier between 1 and 22, preferably between 1.7 and 3.0.

I claim:

1. A process for preparing a soft, non-woven fabric which comprises passing a mat of non-woven fibers free of binder, at least a portion of which fibers comprises thermoplastic fibers, through the nip of opposed rollers without embossing the same, one of which rollers has a heated surface which is uneven and bears against said fabric with sufficient pressure to cause the raised portions of the uneven surface thereof to be depressed within the fibrous mat and to pass and penetrate within the surface of the opposed roller, the roller opposed thereto being resilient, the raised portion of the heated uneven surface having heated teeth which heated teeth pass within the interior of said non-woven fabric while the fabric is maintained free of regions of non-uniform compression whereby to form holes therein and welding of the fibers of said fabric together at the margin of said holes, said fibers being selected from the group consisting of nylon fibers, styrene fibers, styrene copolymer fibers, acrylic fibers, cellulosic fibers, polyolefin fibers and polyvinyl chloride fibers.

2. Process according to claim 1, wherein the temperature of the heated surface is between 110° C. and 250° C.

3. A process according to claim 2, wherein said mat of non-woven fibers is passed through the nip defined by a first roll, having a raised toothed portion thereon, and a second roll, having a resilient surface, at least one of said rolls being heated sufficiently to soften said fibers, the nip between said rolls being sufficiently small to cause the raised toothed portions of the first roll to depress into the surface of the non-woven fibrous mat.

4. A process according to claim 3, wherein both the said rolls are internally heated.

5. A process according to claim 4, wherein the raised toothed portions on the surface of the roll are raised at least 0.2 mm.

6. A process according to claim 5, wherein the area of the raised toothed portion is less than 1 $mm^2$.

7. A process according to claim 6, wherein there are between 5 and 50 raised portions per $cm^2$.

8. A process according to claim 3, wherein the fibrous mat contains at least 10% thermoplastic fibers.

9. A process according to claim 8, wherein said thermoplastic fibers are selected from the group consisting of nylon, styrene, styrene copolymers, acrylics, cellulosics, polyolefins and vinyl polymers.

10. A process according to claim 4, wherein the roll having the resilient surface is internally heated and has resilient needles which extend from an inner heated portion of the roll to the resilient surface, said roll having a surface of silicone rubber.

11. A process according to claim 8, wherein the thermoplastic fibers have a staple length between 0.5 and 8 cm.

12. A process according to claim 3, wherein the fibrous mat is passed through the nip of the rolls at a rate between 1 and 50 meters per minute.

13. A method according to claim 1 wherein said teeth are metallic.

14. A method according to claim 1 wherein the area of the raised portion of said teeth is within the range of 0.5 and 2 $mm^2$.

15. A method according to claim 14 wherein the area of the raised portion of said teeth is less than 1 $mm^2$, said teeth are raised at least 0.2 mm. from the uneven portion of the surface and the distance between said teeth measuredat the apices is between 1 and 2.5 mm.

16. A method according to claim 13 wherein the distance between said teeth measured at their apices is between 1 and 2.5 mm, the apex of a raised portion of said teeth has a surface whose linear dimension in the direction of travel of said non-woven fabric is no greater than 0.06 mm. and the height of each tooth is between 0.1 and 15 mm.

17. A method according to claim 16 wherein the height of said tooth is between 0.5 and 4 mm. and said tooth has a thickness for the raised portion between 0.15 and 1.20 mm.

18. A method according to claim 17 wherein said teeth have a profile in accordance with FIG. 3 of the within specification.

19. A process according to claim 1 wherein said opposed roller is heated.

20. A process according to claim 19 wherein said opposed roller has a surface of silicon rubber.

21. A soft, non-woven fabric free of binding agents and composed, at least in part, of thermoplastic fibers selected from the group consisting of nylon fibers, styrene copolymer fibers, acrylic fibers, cellulose fibers, polyolefin fibers and polyvinylchloride fibers, such fibers bonded to other fibers at their crossing points, said fabric having a smooth surface, said fabric being produced by the process of claim 1.

22. A process for welding thermoplastic fibers selected from the group consisting of nylon fibers, styrene fibers, styrene copolymer fibers, acrylic fibers, cellulosic fibers, polyolefin fibers and polyvinylchloride fibers of a soft, non-woven mat together which comprises passing a mat thereof free of any binder material through the nip of opposed rollers, one of which has protruding heated teeth thereon and the other of which is heated and has a resilient surface, forming a hole in said mat by passing said heated teeth into the interior of said mat and penetrating said opposed roller while maintaining the non-woven fabric free of regions of nonuniform compression and fusing said fibers together at the margin of the hole so formed using the heat supplied by said heated teeth.

23. A process according to claim 22 wherein the fibers of said non-woven mat are fused only in the region of the holes whereby the interstices between the bonded spots have a voluminous and soft character.

* * * * *